US008985823B2

(12) United States Patent
Sugiyama

(10) Patent No.: US 8,985,823 B2
(45) Date of Patent: Mar. 24, 2015

(54) VEHICLE LAMP HAVING AN LED AND A DRIP-PREVENTIVE COVER

(75) Inventor: Takao Sugiyama, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 287 days.

(21) Appl. No.: 13/486,747

(22) Filed: Jun. 1, 2012

(65) Prior Publication Data

US 2012/0307510 A1 Dec. 6, 2012

(30) Foreign Application Priority Data

Jun. 3, 2011 (JP) ..... 2011-124923

(51) Int. Cl.
*F21V 21/00* (2006.01)
*F21S 8/10* (2006.01)

(52) U.S. Cl.
CPC ..... *F21S 48/1104* (2013.01); *F21S 48/1159* (2013.01); *F21S 48/211* (2013.01); *F21S 48/215* (2013.01)
USPC ..... 362/545; 362/507; 362/540; 362/543

(58) Field of Classification Search
USPC ..... 362/507, 540, 543, 544, 545
See application file for complete search history.

(56) References Cited

U.S. PATENT DOCUMENTS 4,868,719 A * 9/1989 Kouchi et al. ..... 362/545
5,361,190 A * 11/1994 Roberts et al. ..... 362/464
5,567,036 A * 10/1996 Theobald et al. ..... 362/485
6,152,590 A * 11/2000 Furst et al. ..... 362/545
6,520,669 B1 * 2/2003 Chen et al. ..... 362/545
6,902,308 B2 * 6/2005 Love ..... 362/545
7,055,996 B2 * 6/2006 Pond et al. ..... 362/498
7,128,452 B2 * 10/2006 Tsai ..... 362/497
7,175,305 B2 * 2/2007 Martineau ..... 362/244
7,261,437 B2 * 8/2007 Coushaine et al. ..... 362/255
2005/0141231 A1 * 6/2005 Takeuchi et al. ..... 362/507

(Continued)

FOREIGN PATENT DOCUMENTS

CN 1753193 A 3/2006
CN 1892944 A 1/2007

(Continued)

OTHER PUBLICATIONS

English Patent Abstract of JP 2009-241921, Publication Date: Oct. 22, 2009 (1 Page).

(Continued)

*Primary Examiner* — Ismael Negron
(74) *Attorney, Agent, or Firm* — Osha Liang LLP

(57) ABSTRACT

A vehicle lamp includes a lamp body having an opening, a front cover attached to the lamp body to close the opening, and a first optical unit disposed inside a lamp chamber defined by the lamp body and the cover. The first optical unit includes a printed wiring board having a first section formed with a first conductor pattern and a second section formed with a second conductor pattern electrically coupled to the first conductor pattern, an LED mounted on the first section of the printed wiring board, and a lighting control circuit provided on the second section of the printed wiring board to control a lighting of the LED. The first optical unit further has a bracket supporting the printed wiring board in a horizontal manner, and a drip-preventive cover covering the lighting control circuit. The drip-preventive cover is provided on the bracket.

9 Claims, 6 Drawing Sheets

(56) References Cited

U.S. PATENT DOCUMENTS

| | | | |
|---|---|---|---|
| 2006/0061994 | A1 | 3/2006 | Liao |
| 2011/0051452 | A1 | 3/2011 | Shih |

FOREIGN PATENT DOCUMENTS

| | | | | |
|---|---|---|---|---|
| CN | 101101093 | A | | 1/2008 |
| CN | 201436462 | U | | 4/2010 |
| JP | 2002-109918 | A | | 4/2002 |
| JP | 2009241921 | A | * | 10/2009 |

OTHER PUBLICATIONS

Office Action issued in counterpart Chinese Patent Application No. 201210180883.X dated Feb. 26, 2014 (14 pages).

Office Action Issued in corresponding Chinese Application No. 201210180883.X, mailed Nov. 4, 2014 (17 pages).

* cited by examiner

VEHICLE LAMP HAVING AN LED AND A DRIP-PREVENTIVE COVER

CROSS-REFERENCE TO RELATED APPLICATIONS

The present application claims priority from Japanese Patent Application No. 2011-124923 filed on Jun. 3, 2011, the entire content of which is incorporated herein by reference.

BACKGROUND OF INVENTION

1. Field of the Invention

The present invention relates to a vehicle lamp having a lamp chamber inside which one or more light emitting diodes (LEDs) are mounted on a printed wiring board and a lighting control circuit is provided to control the lighting of the LEDs.

2. Related Art

A related art vehicle lamp is, for example, a combination headlamp in which two optical units are provided (see, e.g., JP 2009-241921 A).

A first optical unit may be an indicating lamp unit, e.g., a clearance lamp unit, a turn signal lamp unit or a daytime running lamp, disposed near a second optical unit. The second optical unit may be a headlamp unit.

The indicating lamp unit includes, for example, a bracket fixed to a lamp body, a first printed wiring board mounted on a first board mounting portion of the bracket, LEDs mounted on the first printed wiring board, and a plurality of reflectors mounted on the board mounting portion as to face the light emitting axes of the respective LEDs.

To control the lighting of LEDs, a lighting control circuit is mounted on a second printed wiring board mounted on a second board mounting portion of the bracket. The second printed wiring board is spaced rearward from the indicating lamp unit. The first and second printed wiring boards are electrically connected together by wiring.

SUMMARY OF INVENTION

According to the configuration described above, the first printed wiring board on which the LEDs are mounted and the second printed wiring board on which the lighting control circuit is mounted are provided separately. Therefore, wiring for electrically connecting the two printed wiring boards may be indispensable, the number of parts of the indicating lamp unit may be large, and the structure of the indicating lamp unit may be complicated.

Thus, in a conventional vehicle lamp, the occupation ratio of the indicating lamp unit to the lamp chamber may become large, thereby restricting the arrangement the indicating lamp unit inside the lamp chamber.

Furthermore, with a conventional vehicle lamp, because the structure of the indicating lamp unit is complicated, the lamp assembling work may become onerous.

Additionally, with a conventional vehicle lamp, due to the temperature difference between day and night or between the inside and outside of the lamp chamber when the lamp is turned on and off, condensation inside the lamp chamber (e.g., on the inner surface of the front cover or the inner surface of the upper wall of the lamp body) may form water drops dripping down on the light control circuit, whereby the insulation of the lighting control circuit becomes insufficient to prevent the proper control of the lighting of the LEDs.

One or more embodiments of the present invention provide a vehicle lamp configured in view of one or more of the above situations. Those skilled in the art, with the benefit of the present disclosure, will appreciate that other embodiments may be configured in view of other situations.

According to one or more embodiments of the present invention, a vehicle lamp includes a lamp body having an opening, a front cover attached to the lamp body to close the opening, and a first optical unit disposed inside a lamp chamber defined by the lamp body and the cover. The first optical unit includes a printed wiring board having a first section formed with a first conductor pattern and a second section formed with a second conductor pattern electrically coupled to the first conductor pattern, an LED mounted on the first section of the printed wiring board, and a lighting control circuit provided on the second section of the printed wiring board to control a lighting of the LED.

Other aspects and advantages of the invention will be apparent from the following description, the drawings and the claims.

DETAILED DESCRIPTION

Hereinafter, embodiments of the present invention will be described in detail with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

A vehicle lamp according to one or more embodiments of the present invention is a vehicle headlamp 10. The vehicle headlamp 10 is mounted on right and left sides of the front end portion of a vehicle, on respective side in the vehicle width direction.

The vehicle headlamp 10 includes a lamp body 12 having a front opening, and a front cover 14 attached to a peripheral edge portion of the front opening of the lamp body 12. A lamp chamber S is defined by the lamp body 12 and front cover 14.

Figure 1:
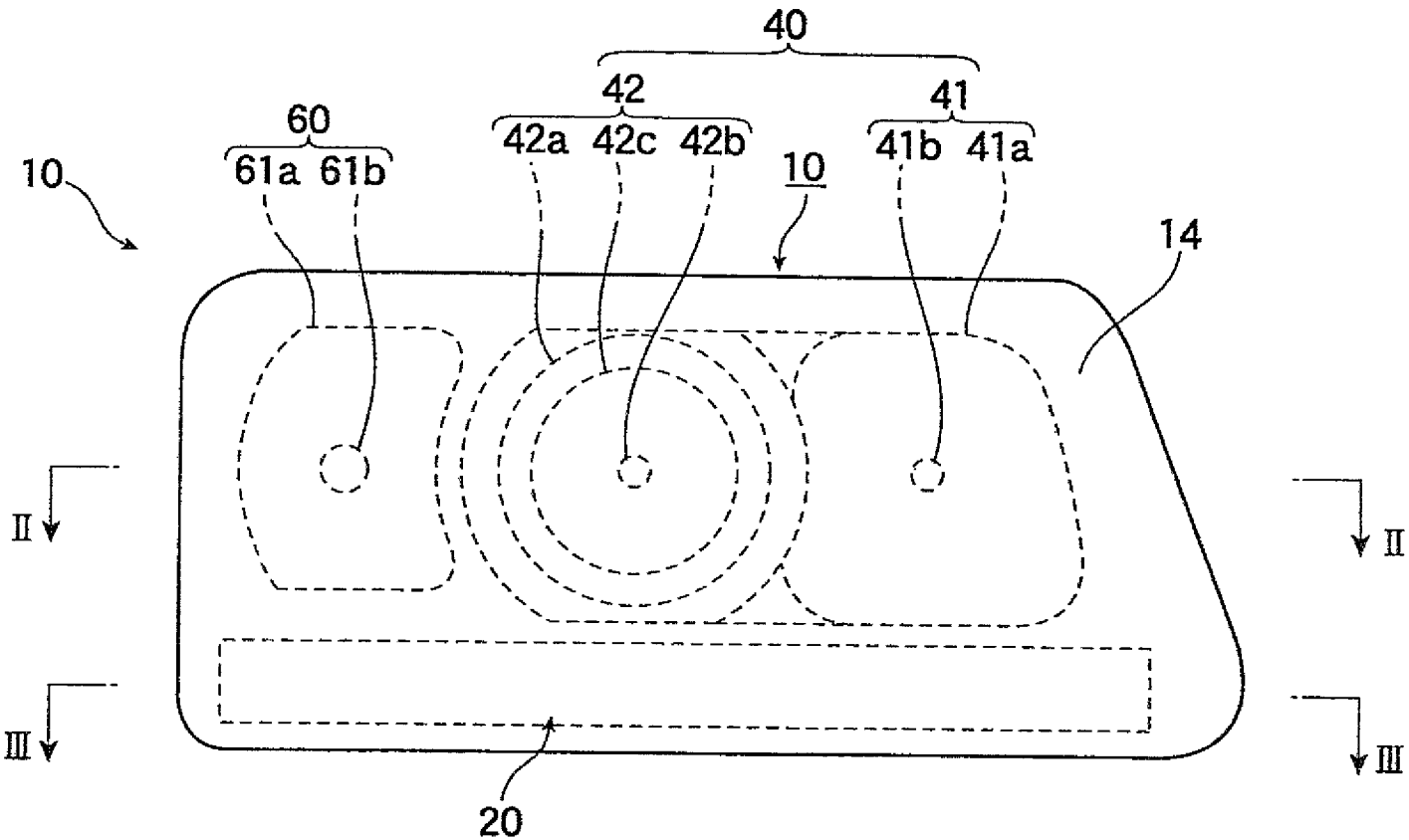
FIG. 1 is a schematic front view of a vehicle headlamp according to one or more embodiments of the present invention.
Figure 2:
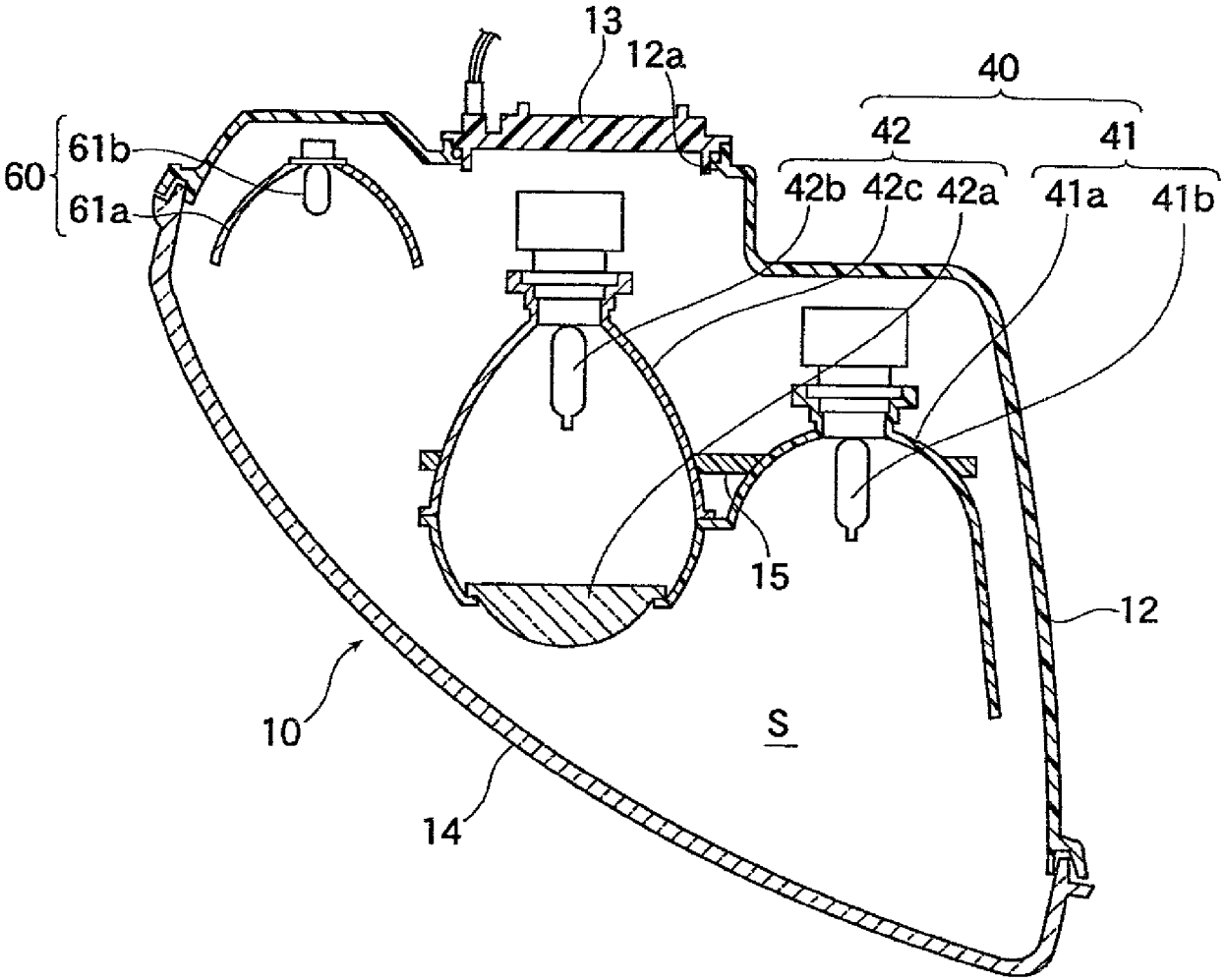
FIG. 2 is a horizontal sectional view of the vehicle headlamp, taken along the line II-II in FIG. 1.

Inside the lamp chamber S, as shown in FIGS. 1 and 2, an indicating lamp unit 20 (a first optical unit), a headlamp unit 40 (a second optical unit), and another indicating lamp unit 60 (a third optical unit) are provided. The indicating lamp unit 20 is disposed in a lower region inside the lamp chamber and extends from the vehicle front side (inner side in the vehicle width direction) to the vehicle lateral side. The headlamp unit 40 is disposed in an upper region inside the lamp chamber on the inner side in the vehicle width direction, and the indicating lamp unit 60 is disposed in an upper region inside the lamp chamber on the vehicle lateral side. In the illustrated example, the indicating lamp unit 20 is a daytime running lamp, and the other indicating lamp unit 60 is a turn signal lamp.

The headlamp unit 40 is assembled such that a low beam lamp 41 and a high beam lamp 42 are mounted side by side in a lateral direction on a lamp bracket 15. The headlamp unit 40 can be inclined and adjusted in the vertical and horizontal directions (the optical axes of the lamps 41, 42 can be inclined and adjusted in the vertical and horizontal directions) by an aiming mechanism (not shown) interposed between the back wall of the lamp body 12 and lamp bracket 15.

The low beam lamp 41 has a parabolic reflector 41*a* and a light source bulb 41*b*. The high beam lamp 42 has an elliptic reflecting mirror 42*a*, a light source bulb 42*b* and a projection convex lens 42*c*. A removable back cover 13 is mounted on an opening portion 12*a* formed in the back wall of the lamp body 12.

The indicating lamp unit 60 (turn signal lamp) is disposed on the lateral surface side of the vehicle in order to provide excellent visibility. The indicating lamp unit 60 includes a parabolic reflector 61*a* fixed to the lamp body 12 and a light source bulb 61*b* inserted into a bulb insertion hole 12*b* formed in the back wall of the lamp body 12 and having a light emitting portion extended forwardly of the reflector 61*a*.

The indicating lamp unit 20 is formed to have an oblong shape for enhanced visibility and is disposed in the lower region inside the lamp chamber S from the vehicle front side to the lateral side.

Figure 3:
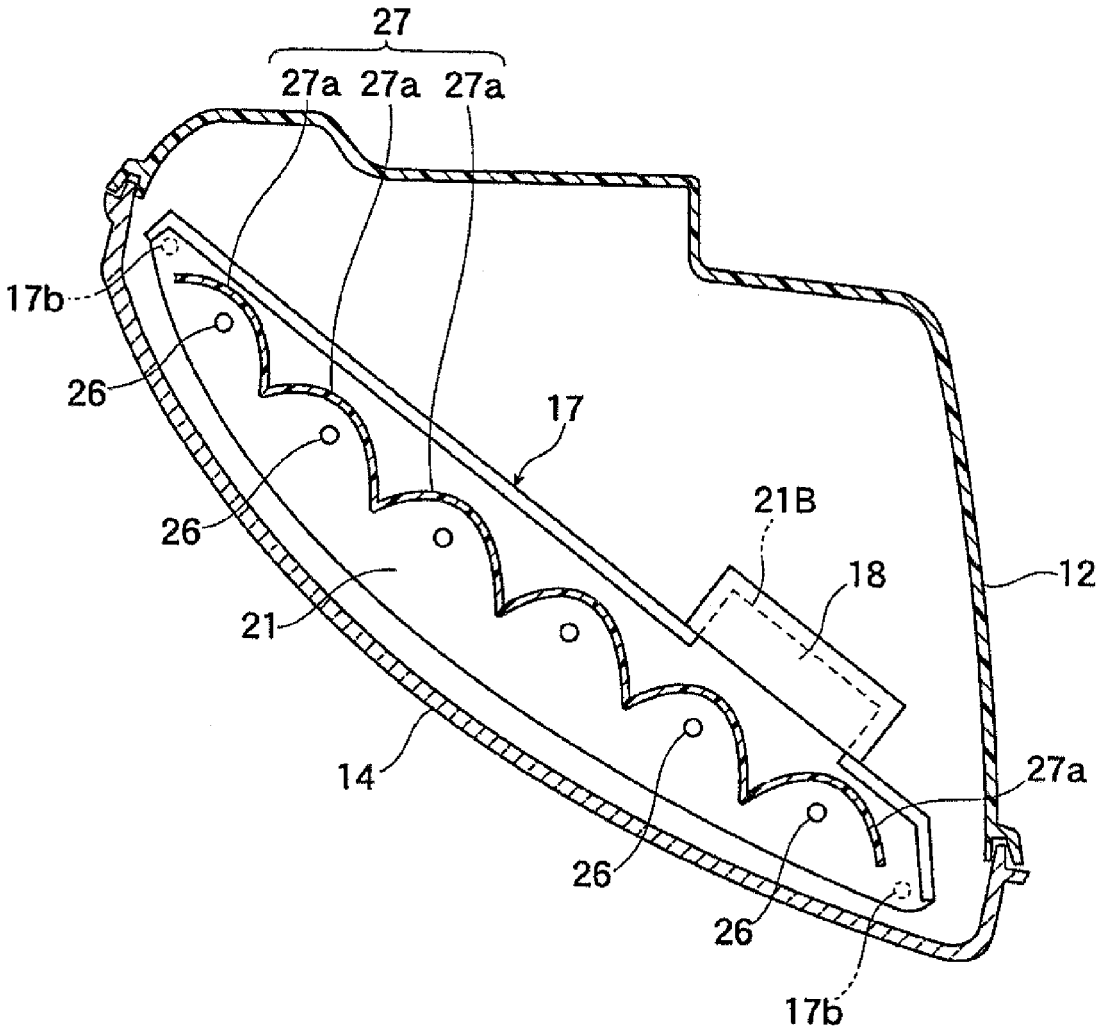
FIG. 3 is a horizontal sectional view of the vehicle headlamp, taken along the line III-III in FIG. 1.
Figure 7:
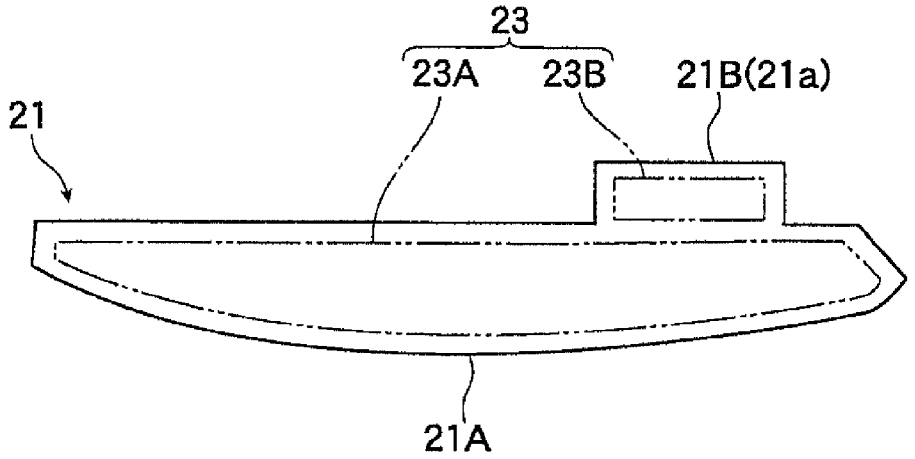
FIG. 7 is a plan view of the printed wiring board.

As shown in FIGS. 3 and 7, the daytime running lamp 20 includes a printed wiring board 21 having a conductor pattern 23, LEDs 26 (light sources) mounted on the printed wiring board 21, a lighting control circuit 28 mounted on the printed wiring board 21 to control the lighting of the LEDs 26, and a reflector unit 27 mounted on the printed wiring board 21 to forwardly reflect light emitted by the LEDs 26.

The printed wiring board 21 is configured such that the conductor pattern 23 is formed on a resin substrate having a thickness of, for example, about 1.6 mm and an insulation protection film is placed on the conductor pattern 23 to cover it except for the LED 26 mounting land portion (terminal) and lighting control circuit 28 mounting land portion (terminal) of the conductor pattern 23.

As shown in FIG. 7, the conductor pattern 23 includes a first conductor pattern 23A forming electrically conducting paths for the LEDs 26 and a second conductor pattern 23B forming electrically conducting paths of the lighting control circuit 28. The second conductor pattern 23B is electrically coupled to the first conductor pattern 23A.

More specifically, as shown in FIG. 7, the printed wiring board 21 has a first conductor pattern section 21A in which the first conductor pattern 23A is formed and a second conductor pattern section 21B in which the second conductor pattern 23B is formed. The first conductor pattern section 21A has a substantially rectangular shape when viewed from above. The second conductor pattern section 21B rearwardly extends like a tongue from a rear side of the first conductor pattern section 21A. The LEDs 26 are mounted on the first conductor pattern section 21A. The lighting control circuit 28 is provided on the second conductor pattern section 21B.

That is, unlike the related art, wiring for electrically connecting the two printed wiring board, which may cause disconnection at a connecting point between the wiring and the printed wiring board due to vibration or the like, becomes unnecessary.

Figure 4:
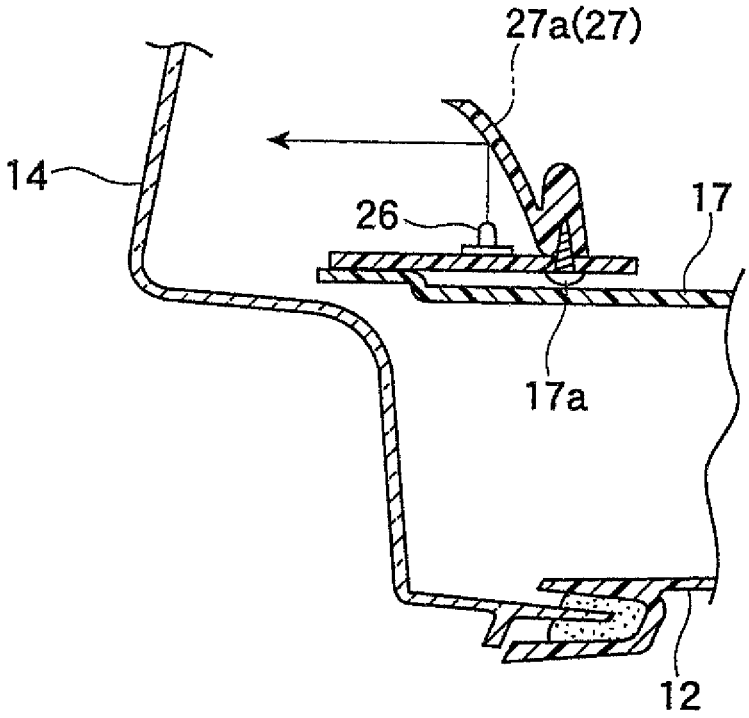
FIG. 4 is a vertical sectional view of a portion of the vehicle headlamp, illustrating an indicating lamp unit of the vehicle headlamp.

As shown in FIG. 3, a reflector unit 27 is mounted on the upper surface of the printed wiring board 21 behind the LEDs 26. The reflector unit 27 has a plurality of reflectors 27*a* corresponding to the respective LEDs 26. The reflectors 27*a* are arranged side by side in the lateral direction, and are formed as a one-piece structure. As shown in FIG. 4, the reflector unit 27 may be secured to the printed wiring board 21 by a fastening screw 17*a*.

The reflectors 27*a* of the reflector unit 27, as shown in FIG. 4, are disposed to face the light emitting axes of their corresponding LEDs 26, whereby the emission lights of the LEDs 26 can be reflected and distributed forwardly of the lamp chamber S by the reflector unit 27 (reflectors 27*a*). Light diffusing steps are formed on an inner side of each of the reflectors 27*a*, whereby lights reflected by the reflectors 27*a* are distributed forwardly as diffused lights.

The lighting control circuit 28 is mounted behind the reflector unit 27. Therefore, the lighting control circuit 28 does not interfere with the light distribution from the reflector unit 27. Further, because the lighting control circuit 28 is concealed behind the reflector unit 27, appearance of the headlamp 10 is not deteriorated.

Figure 6:
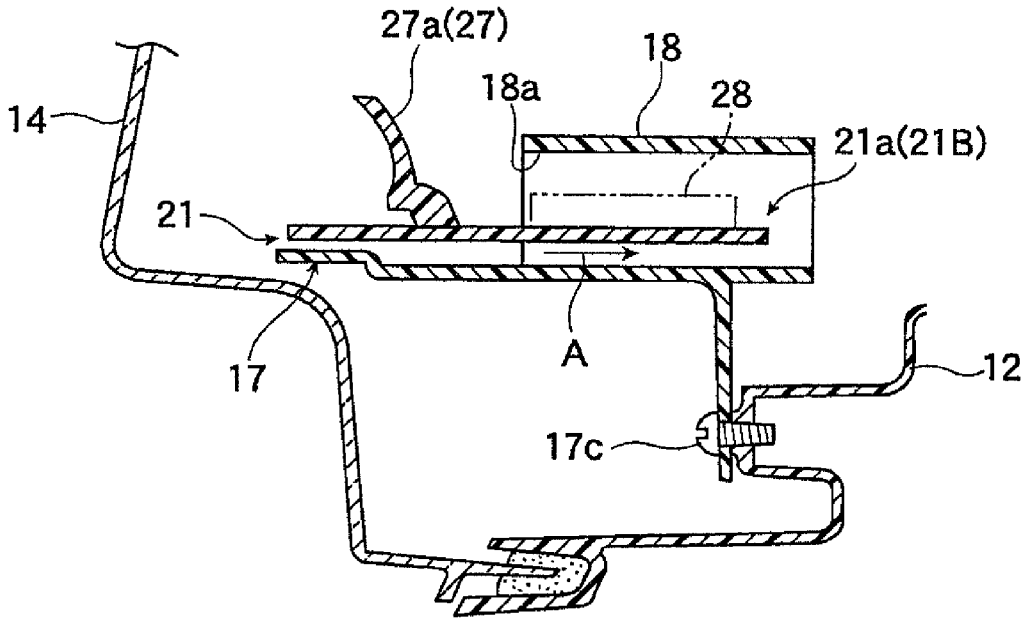
FIG. 6 is a vertical sectional view of a portion of the vehicle headlamp, illustrating a drip-preventive cover arranged to cover a lighting control circuit.

As described above, the LEDs 26, the lighting control circuit 28 and the reflector unit 27 are mounted on the printed wiring board 21. As shown in FIGS. 3, 4 and 6, the printed wiring board 21 is supported by a bracket 17 in a horizontal manner. The bracket 17 may be made of synthetic resin. The bracket 17 is fixed to the lamp body 12, and extends inside the lamp chamber S. As shown in FIG. 3, the printed wiring board 21 may be secured to the bracket 17 by fastening screws 17*b*. As shown in FIG. 6, the bracket 17 may be secured to the lamp body 12 by a fastening screw 17*c*.

Figure 5:
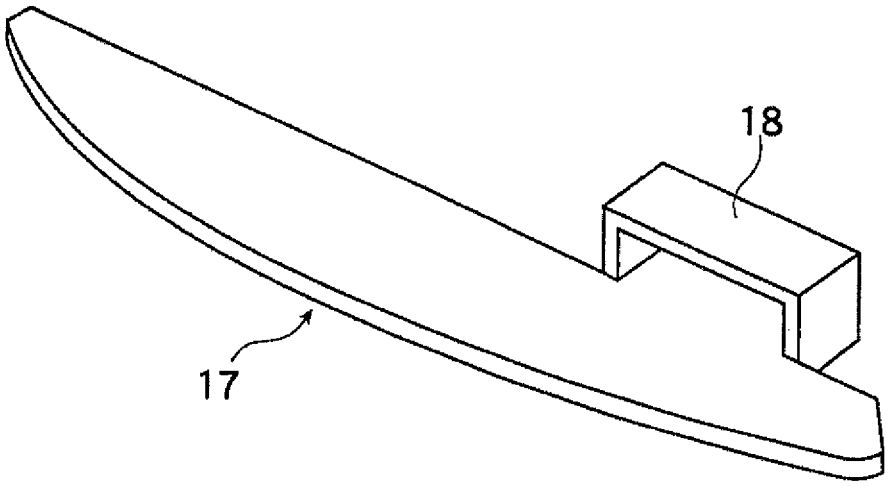
FIG. 5 is a perspective view of a bracket for supporting a printed wiring board.

As shown in FIGS. 5 and 6, a drip-preventive cover 18 is provided to cover the lighting control circuit mounting area 21*a* (the second conductor pattern section 2113) of the printed wiring board 21, on which lighting control circuit 28 is mounted, so that the lighting control circuit 28 is prevented from being affected by dew drops. The drip-preventive cover 18 has a front opening and a rear opening. The bracket 17 and the drip-preventive cover 18 may be formed as a one-piece structure, e.g., as a molded piece made of synthetic resin. This is advantageous in that no fastening means is necessary for providing the drip-preventive cover 18 on the bracket 17.

That is, there is a fear that condensation can be produced inside the lamp chamber S (for example, the back surface of the front cover 14 or the upper wall of the lamp body 12) due to the temperature difference between day and night or between the inside and outside of the lamp chamber S when the lamp is turned on or off and such condensation can form water drops to drip downward. However, the drip-preventive cover 18 covering the lighting control circuit 28 can prevent the water drops from invading (dropping down into) the lighting control circuit 28. This can prevent the malfunction of the lighting control circuit 28 due to the water drops, thereby enabling to secure the accurate lighting control of the LEDs 26.

When the printed wiring board 21 is slid in the arrow A direction of FIG. 6 relative to the bracket 17 so that the lighting control circuit mounting area 21*a* of the printed wiring board 21 is inserted into the front side opening 18*a* of the drip-preventive cover 18, the printed wiring board 21 can be assembled to the bracket 17 in a state where the lighting control circuit 28 is covered with the drip-preventive cover 18.

There is also a fear that, as the headlamp unit 40 having a large light emission amount turns on, the inside of the lamp chamber S becomes high in temperature to thereby lower the light emission amounts of the LEDs 26 serving as the light sources of the indicating lamp unit 20 inside the lamp chamber S or degrade the properties of electronic parts of the lighting control circuit 28.

However, according to one or more embodiments of the present invention, the indicating lamp unit (daytime running lamp) 20 is disposed below the headlamp unit 40 the temperature of which becomes high when lighted, whereby heat generated by the headlamp unit 40, due to the convection of air inside the lamp chamber 5, is mainly transmitted upwardly inside the lamp chamber S and is hard to be transmitted downwardly inside the lamp chamber S. Therefore, the LEDs 26 serving as the light sources of the indicating lamp unit (daytime running lamp) 20 and lighting control circuit 28 are accordingly harder to be influenced by the heat of the headlamp unit 40 when lighted.

Further, because the LEDs 26 are mounted with their light emitting axes facing upwardly and the reflector unit 27 (reflectors 27*a*) is disposed on the upper surface side of the printed wiring board 21 with the lighting control circuit 28 mounted thereon, the LEDs 26 and lighting control circuit 28 easy to be influenced by heat are spaced from the high-temperature headlamp unit 40 at least a distance corresponding to the height of the reflector unit 27 (reflectors 27*a*). Therefore, the LEDs 26 and lighting control circuit 28 are accordingly harder to be influenced by the heat.

To manufacture the printed wiring board 21, a conductive film made of copper or the like is formed on the entire surface the resin substrate B and, using a given etching mask, the conductive film is etched to thereby form the given wiring conductor pattern 23 (23A, 23B). Then, the insulation protection film is placed on the conductor pattern 23 (23A, 23B) to cover the conductor pattern 23 except for the LEDs mounting land portion (terminal) of the first conductor pattern 23A and the lighting control circuit mounting land portion (terminal) of the second conductor pattern 23B. Next, after the LEDs 26 and lighting control circuit 28 are mounted on the respective land portions (terminals), the resin substrate B formed with the conductor pattern 23 and insulation protection film is cut so that it has a given outer shape, thereby producing the printed wiring board 21 on which the LEDs 26 and lighting control circuit 28 are mounted.

Figure 8:
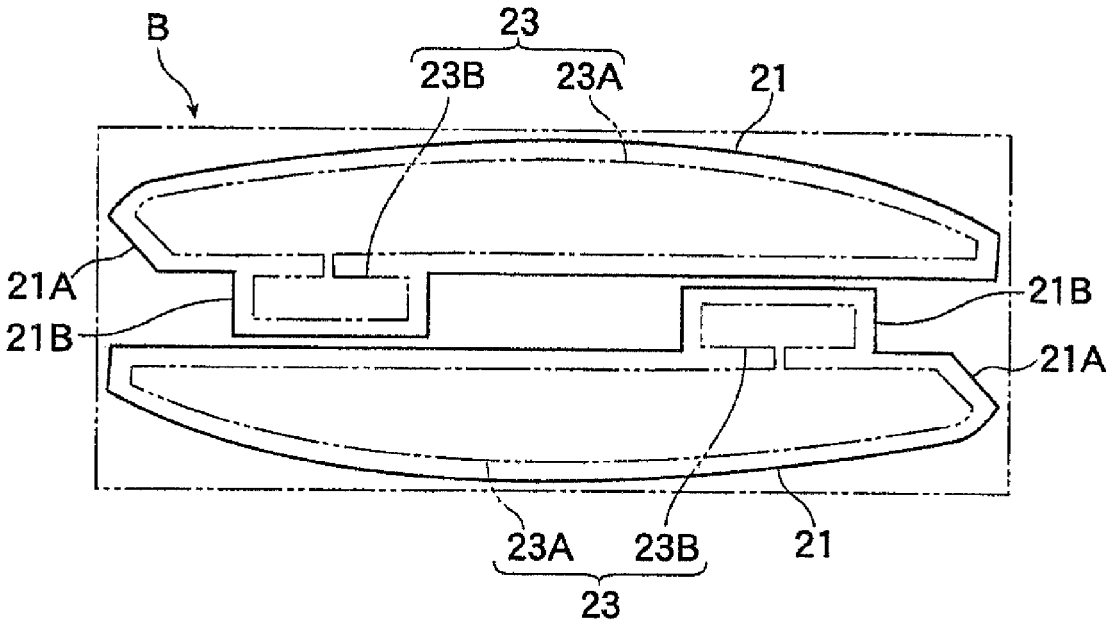
FIG. 8 is an explanatory view illustrating how two printed wiring boards are produced from a single board.

As described above, the printed wiring board 21 has such a shape that the second conductor pattern section 21B extends like a tongue from one side of the first conductor pattern section 21A having a substantially rectangular shape. Accordingly, as shown in FIG. 8, two printed wiring boards 21 can be produced from a single sheet of resin substrate B in a rotationally symmetric manner. This can reduce the wasteful use of the material.

Specifically, a conductive film made of copper or the like is formed on the entire surface of the resin substrate B and then, using a given etching mask, the conductive film is etched, whereby the wiring conductor patterns 23, 23 are formed in rotational symmetry such that their respective second conductor patterns 23B, 2313 adjoin each other in the longitudinal direction. Next, an insulation protection film is so placed on the conductor patterns 23, 23 as to cover their surfaces except for the LEDs mounting land portion (terminal) of the first conductor pattern 23A and the lighting control circuit mounting land portion (terminal) of the second conductor pattern 23B. Then, after the LEDs 26 and the lighting control circuits 28, are mounted on their corresponding given land portions (terminals), the resin substrate B is cut so as to provide a given shape, thereby producing printed wiring boards 21, 21 each mounted with the LEDs 26 and the lighting control circuit 28. Finally, when the reflectors 27, 27 are mounted onto the printed wiring boards 21, 21 respectively, the indicating lamp units 20, 20 to be incorporated into the lamp chamber S are completed.

One or more embodiments of the present invention may provide one or more of the following advantages.

Firstly, because the indicating lamp unit 20 is compact as a whole, the freedom of the arranging position of the indicating lamp unit 20 inside the lamp chamber S can be enhanced, thereby enabling to provide a novel vehicle headlamp with the indicating lamp unit 20 disposed at a given position inside the lamp chamber S.

Secondly, because the assembling of the indicating lamp unit 20 into the lamp chamber S is simplified, the lamp 10 assembling process can be simplified.

Thirdly, because the electrically conducting paths in the indicating lamp unit 20 are hardly disconnected, the durability of the indicating lamp unit 20 can be ensured.

Fourthly, because the lighting control circuit 28 is prevented against the influence of condensation, the long stable lighting control of the LEDs 26 can be ensured.

According to one or more embodiments of the present invention, the time required for the process for assembling the optical unit 20 into the lamp chamber S can be shortened greatly when compared with the prior art and the lamp manufacturing cost can also be reduced.

That is, in the case of the LEDs 26, since, even when they are standardized LEDs of the same output, their light emission amounts (brightness levels) differ according to classes. Thus, it is advantageous that the lighting control circuit 28 mounted on the printed wiring board 21 matches (corresponds) to the classes of the LEDs 26 (lighting control circuit 28 which, for the LED 26 of a small light emission amount, can increase the light emission amount to thereby be able to provide a constant light emission amount).

However, conventionally, a printed wiring board for mounting the LEDs thereon and a printed wiring board for mounting a lighting control circuit thereon are formed separately. Thus, a printed wiring board with LEDs mounted thereon and a printed wiring board with a lighting control circuit mounted thereon are assembled according to separate processes. Therefore, before the printed wiring board with LEDs mounted thereon and the printed wiring board with a lighting control circuit mounted thereon are assembled into a lamp chamber as optical units, it is necessary to confirm whether the LEDs and lighting control circuit match (correspond) to each other or not.

Specifically, in the case of the LEDs 26, even when they are the same standardized LEDs, they are divided into 1 to 5 ranks differing in the light emission amount (brightness). Thus, in the LEDs mounting process, there are manufactured five kinds of LEDs mounted printed wiring boards ranging from a printed wiring board 21 with LEDs 26 of a rank 1 mounted thereon to a printed wiring board 21 with LEDs 26 of a rank 5 mounted thereon. Also, in the lighting control circuit mounting process, there are manufactured five kinds of lighting control circuit mounted printed wiring boards of Therefore, conventionally, before the printed wiring board with LEDs mounted thereon and the printed wiring board with a lighting control circuit mounted thereon are assembled into a lamp chamber as optical units, it is necessary to confirm whether the rank of the LEDs mounted printed wiring board (the rank of the LEDs) and the class of the lighting control circuit mounted printed wiring board match (correspond) to each other (for example, the ranks 1 to 5 and the classes of 1 to 5 match respectively) or not.

Thus, conventionally, since there is necessary the process to confirm whether the rank of LEDs mounted on a printed wiring board matches to the class of a lighting control circuit mounted on a printed wiring board or not, it takes time accordingly to assemble the optical unit and the facility necessary for such confirming process increases the manufacturing cost.

However, according to one or more embodiments of the present invention, because an LEDs mounting printed wiring board and a lighting control circuit mounting printed wiring board are structured as common printed wiring boards 21, in a process for mounting the LEDs 26 onto the printed wiring board 21 and then mounting the lighting control circuit 28, the LEDs 26 and lighting control circuit 28 can be mounted onto their printed wiring boards 21 with the rank of the LEDs 26 and the class of the lighting control circuit 28 confirmed.

Therefore, in the printed wiring boards 21 respectively with the LEDs 26 and lighting control circuit 28 manufactured in the LED/lighting control circuit mounting process, the rank of the LEDs 26 and the class of the lighting control circuit 28 always match (correspond) to each other. This can eliminate the conventionally necessary process to confirm whether the rank of LEDs mounted on a printed wiring board and the class of a lighting control circuit mounted on a printed wiring board match to each other or not. This can shorten greatly the time necessary for the process for assembling the optical unit 20 into the lamp chamber S and also can eliminate the need for provision of the above facility for confirming the rank of the LEDs and the class of the lighting control circuit, thereby enabling to reduce the manufacturing cost of the lamp 10.

According to one or more embodiments, the bracket 17 and the drip-preventive cover 18 may be provided as separate pieces, and may be attached together using a screw or by other fixing means.

According to one or more embodiments, the LEDs 26 and lighting control circuit 28 are mounted on the upper surface side of the horizontally disposed printed wiring boards 21 and the reflectors 27 are further mounted thereon. However, the LEDs 26 and lighting control circuit 28 may be mounted on the lower surface side of the horizontally disposed printed wiring boards 21 and the reflectors 27 are further mounted thereon.

According to one or more embodiments, the printed wiring boards 21 with the LEDs 26, lighting control circuit 28 and reflectors 27 mounted thereon are disposed horizontally. However, the printed wiring boards 21 with the LEDs 26 and lighting control circuit 28 may also be disposed horizontally with their board width direction being substantially vertical. The light distribution of the optical unit 20 may also be formed by the direct lights of the LEDs 26 so mounted on the printed wiring board 21 as to have light emitting axes facing forwardly of the lamp chamber, or by the direct lights of the LEDs 26 and the reflected lights of the reflector unit 27 (reflectors 27*a*) mounted on the printed wiring board 21.

According to one or more embodiments, two printed wiring boards 21 are produced from a sheet of resin substrate B. However, when the printed wiring boards 21 are small in size (length), four or six boards may be produced.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A vehicle lamp comprising:

a lamp body having an opening;

a front cover attached to the lamp body to close the opening; and a first optical unit disposed inside a lamp chamber defined by the lamp body and the cover, wherein the first optical unit comprises:

a printed wiring board comprising a first section formed with a first conductor pattern and a second section formed with a second conductor pattern electrically coupled to the first conductor pattern;

an LED mounted on the first section of the printed wiring board; and a lighting control circuit provided on the second section of the printed wiring board to control lighting of the LED, wherein the first optical unit further comprises:

a bracket supporting the printed wiring board in a horizontal manner; and a drip-preventive cover covering the lighting control circuit, wherein the drip-preventive cover is provided on the bracket, and wherein the drip-preventive cover has a front opening such that the second section of the printed wiring board is inserted into the front opening.

2. The vehicle lamp according to claim 1, wherein the second section of the printed wiring board extends rearward from a rear side of the first section of the printed wiring board.

3. The vehicle lamp according to claim 1, further comprising a second optical unit arranged inside the lamp chamber and above the first optical unit.

4. The vehicle lamp according to claim 1, wherein the drip-preventive cover and the bracket are formed as a one-piece structure.

5. The vehicle lamp according to claim 4, wherein the drip-preventive cover and the bracket are formed as a single molded piece made of synthetic resin.

6. The vehicle lamp according to claim 1, wherein the first optical unit further comprises a reflector mounted on the printed wiring board to distribute light emitted by the LED toward the front cover.

7. The vehicle lamp according to claim 6, wherein the lighting control circuit is arranged behind the reflector in a front view of the vehicle lamp.

8. The vehicle lamp according to claim 1, wherein a plurality of said LEDs are mounted on the first section of the printed wiring board, and the lighting control circuit is configured to control the plurality of LEDs.

9. The vehicle lamp according to claim 8, wherein the second optical unit is configured as a headlamp unit to form at least one of a low beam and a high beam.

* * * * *